US010744365B2

(12) United States Patent
Kuo

(10) Patent No.: US 10,744,365 B2
(45) Date of Patent: Aug. 18, 2020

(54) WEIGHT TRAINING MACHINE CAPABLE OF ADJUSTING STRENGTH

(71) Applicant: Sports Art Industrial Co., Ltd., Tainan (TW)

(72) Inventor: Hai-Pin Kuo, Tainan (TW)

(73) Assignee: Sports Art Industrial Co., Ltd., Tainan (TW)

( * ) Notice: Subject to any disclaimer, the term of this patent is extended or adjusted under 35 U.S.C. 154(b) by 92 days.

(21) Appl. No.: 16/181,281

(22) Filed: Nov. 5, 2018

(65) Prior Publication Data

US 2019/0134450 A1 May 9, 2019

(51) Int. Cl.

| | |
|---|---|
| ***A63B 21/062*** | (2006.01) |
| ***A63B 21/00*** | (2006.01) |
| ***A63B 1/00*** | (2006.01) |

(52) U.S. Cl.

CPC ..... *A63B 21/063* (2015.10); *A63B 1/00* (2013.01); *A63B 21/152* (2013.01); *A63B 21/156* (2013.01); *A63B 21/4033* (2015.10)

(58) Field of Classification Search

CPC ..... A63B 21/063; A63B 1/00; A63B 21/152; A63B 21/4033; A63B 21/156; A63B 21/00; A63B 2209/08; A63B 2225/093

See application file for complete search history.

(56) References Cited

U.S. PATENT DOCUMENTS

| | | | | |
|---|---|---|---|---|
| 3,438,627 | A * | 4/1969 | La Lanne | A63B 21/154 482/103 |
| 4,154,441 | A * | 5/1979 | Gajda | A63B 21/0626 482/102 |
| 4,402,504 | A * | 9/1983 | Christian | A63B 21/06 482/103 |
| 4,603,855 | A * | 8/1986 | Sebelle | A63B 21/06 482/103 |
| 4,640,268 | A * | 2/1987 | Roberts | A63B 21/06 482/139 |
| 5,102,122 | A * | 4/1992 | Piane, Jr. | A63B 21/156 482/103 |
| 5,725,459 | A * | 3/1998 | Rexach | A63B 23/1209 482/92 |
| 6,165,110 | A * | 12/2000 | Gajda | A63B 21/06 482/102 |
| 6,217,493 | B1 * | 4/2001 | Spletzer | A63B 21/0605 482/103 |
| 6,394,935 | B1 * | 5/2002 | Lake | A63B 21/154 482/93 |
| 6,685,600 | B1 * | 2/2004 | Ullman | A63B 21/156 482/100 |
| 6,770,015 | B2 * | 8/2004 | Simonson | A63B 21/154 482/101 |

(Continued)

*Primary Examiner* — Garrett K Atkinson

(57) ABSTRACT

A weight training machine generally includes a supportive frame, a first mechanism, and a second mechanism. The first mechanism includes a first weight stack, a first cable system, and a second cable system. The second mechanism includes a second weight stack, a third cable system, and a fourth cable system. In each of the first and second mechanisms, one end of a cable can be easily attached to a moving pulley block to have the moving pulley block converted to a fixed pulley block. As a result, the force applied to a handle for lifting the associated weight stack becomes double as compared to the cable being not attached to the moving pulley block.

5 Claims, 8 Drawing Sheets

(56) References Cited

U.S. PATENT DOCUMENTS 7,335,141 B2 * 2/2008 Piane, Jr. ..... A63B 21/055 482/101
7,503,882 B2 * 3/2009 Sechrest ..... A63B 21/152 482/103
7,654,942 B1 * 2/2010 Batca ..... A63B 21/156 482/135
7,758,478 B2 * 7/2010 Golesh ..... A63B 21/0628 482/93
8,246,524 B2 * 8/2012 Castillo ..... A63B 21/023 482/101
8,968,164 B2 * 3/2015 Giannelli ..... A63B 21/154 482/102
9,050,496 B2 * 6/2015 Towley, III ..... A63B 23/1209
9,821,188 B2 * 11/2017 Dwork ..... A63B 21/16
2001/0034290 A1 * 10/2001 Tolles ..... A63B 21/152 482/99
2002/0091043 A1 * 7/2002 Rexach ..... A63B 21/0628 482/98
2004/0018920 A1 * 1/2004 Simonson ..... A63B 21/154 482/99
2007/0042878 A1 * 2/2007 Lundquist ..... A63B 21/06 482/99
2008/0242520 A1 * 10/2008 Hubbard ..... A63B 21/063 482/98
2008/0287270 A1 * 11/2008 Carter ..... A63B 21/154 482/99
2008/0300116 A1 * 12/2008 Eder ..... A63B 21/156 482/100
2011/0230315 A1 * 9/2011 Castillo ..... A63B 21/023 482/94
2013/0065737 A1 * 3/2013 Habing ..... A63B 21/156 482/102
2013/0303346 A1 * 11/2013 Barker ..... A63B 21/018 482/129
2013/0337982 A1 * 12/2013 Williams ..... A63B 21/02 482/122

* cited by examiner

WEIGHT TRAINING MACHINE CAPABLE OF ADJUSTING STRENGTH

FIELD OF THE INVENTION

The present invention relates to a weight training machine capable of adjusting strength and, more particularly, to a weight training machine that can be adjusted easily without using any tools to double its original training strength.

DESCRIPTION OF THE PRIOR ART

Conventional weight training machines can be used for increasing muscle strength, improving body type, and reducing excess fat, so that they are widely used by ordinary people. However, for adjusting the training strength of conventional machines, users have to disassemble the associated weight stack thereof and take different weight plates to replace the original plates of the weight stack, and this is incovenient.

Thus, there is a need for improving the conventional machines. In the present invention, the strength of a weight training machine can be increased by attaching one end of a cable to a moving pulley block without using any tools, thus facilitating a user to proceed with a weight training course.

SUMMARY OF THE INVENTION

One object of the present invention is to provide a weight training machine capable of adjusting training strength, which generally comprises a supportive frame, a first mechanism, and a second mechanism. The first mechanism includes a first weight stack, a first cable system, and a second cable system. The second mechanism includes a second weight stack, a third cable system, and a fourth cable system. In each of the first and second mechanisms, one end of a cable can be attached to a moving pulley block thereof to have the moving pulley block converted to a fixed pulley block. As a result, the force applied to a handle thereof for lifting the associated weight stack becomes double as compared to the cable being not attached to the moving pulley block.

Other objects, advantages, and novel features of the present invention will become more apparent from the following detailed description when taken in conjunction with the accompanying drawings.

DETAILED DESCRIPTION OF THE PREFERRED EMBODIMENTS

Figure 1:
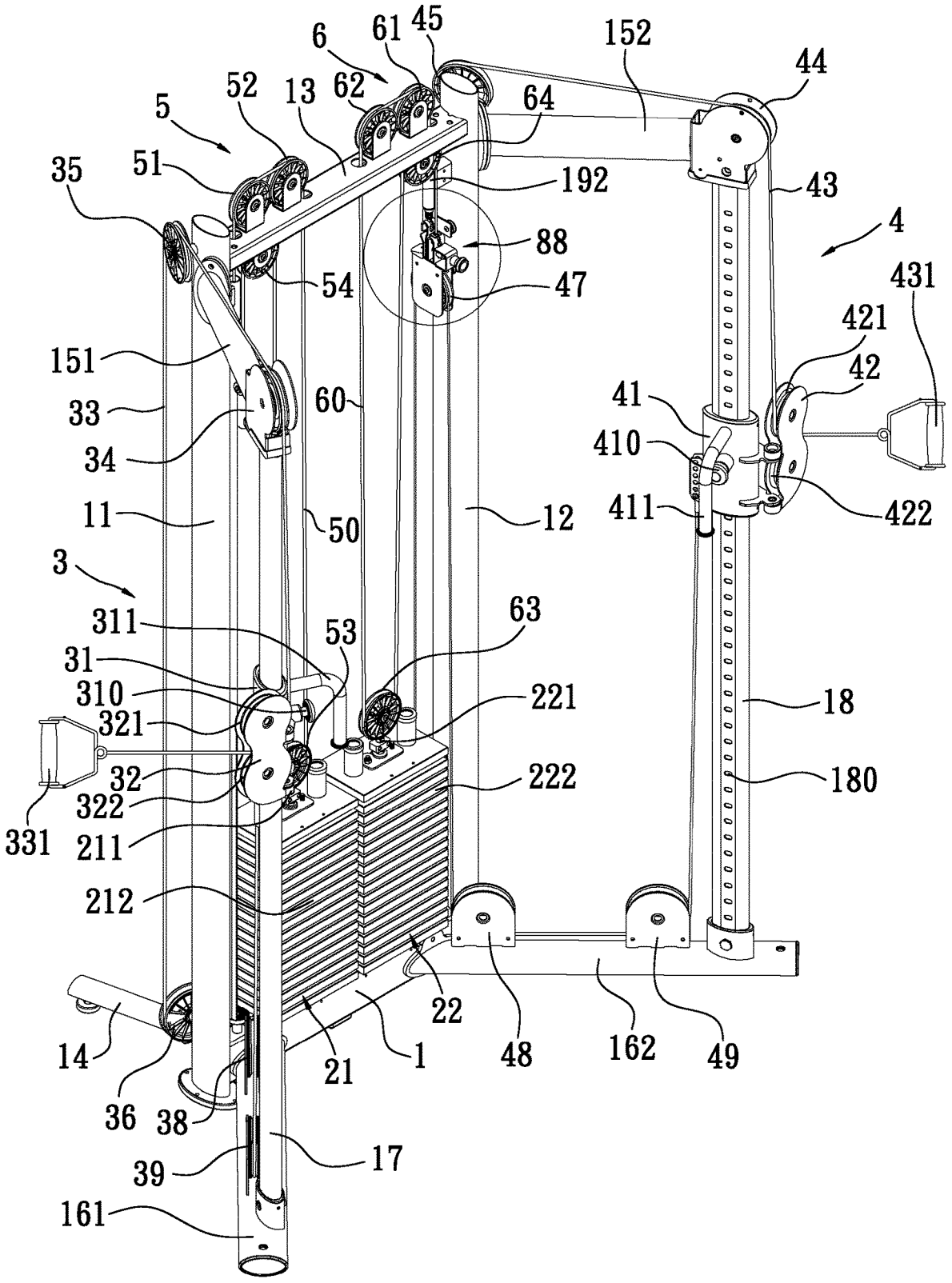
FIG. 1 shows a 3-dimensional view of a weight training machine according to one embodiment of the present invention.
Figure 2:
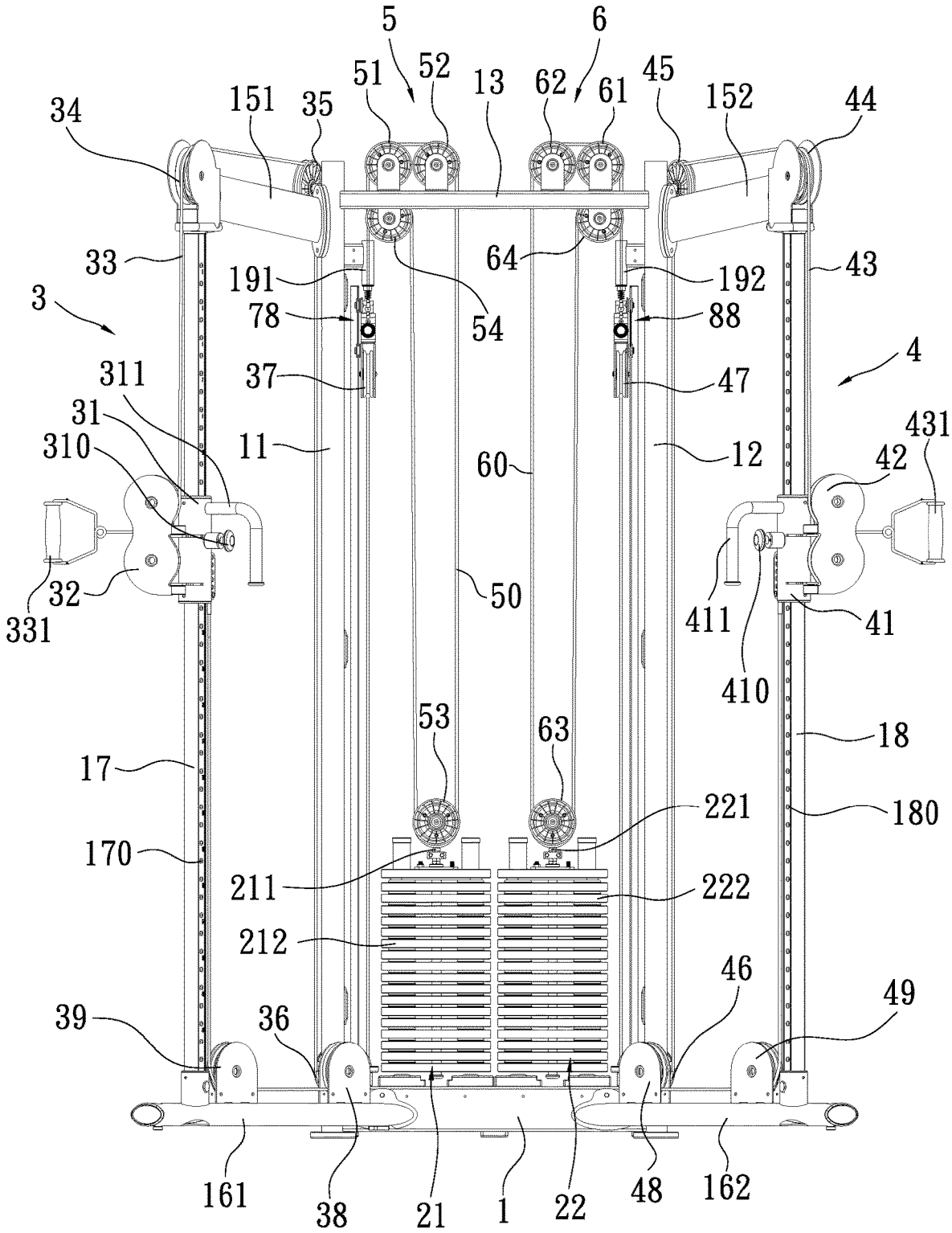
FIG. 2 shows a front view of the weight training machine of the embodiment.
Figure 3:
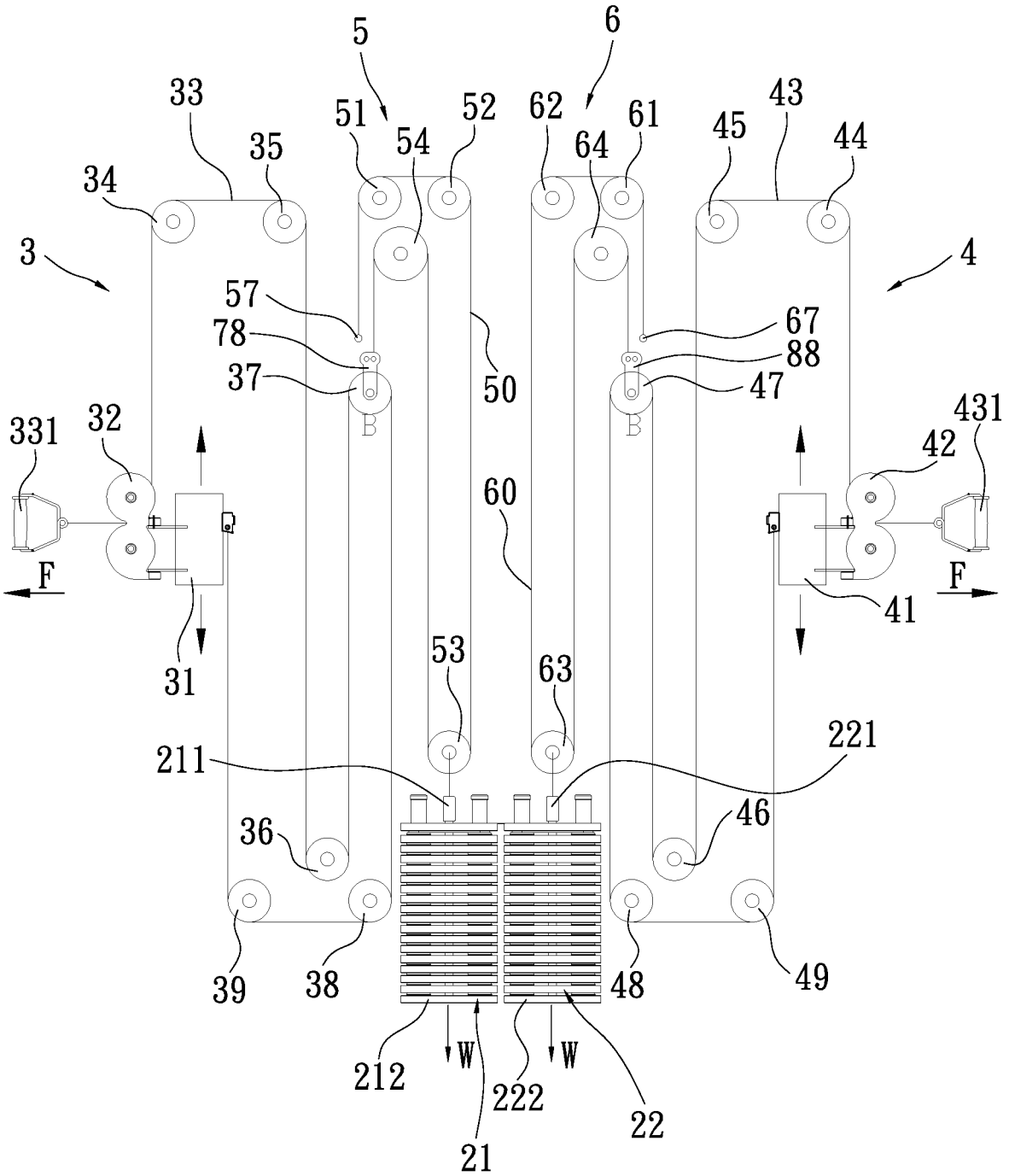
FIG. 3 shows a schematic view of the weight training machine of the embodiment, wherein the force applied to each handle for lifting a weight stack is manifested.

Referring to FIGS. 1 through 3, a weight training machine according to one embodiment of the present invention is shown, which generally comprises a supportive frame, a first mechanism, and a second mechanism. The supportive frame is constructed of a base formed of a central bottom tube 1 and two front bottom tubes 161, 162 respectively extending from two opposite ends of the central bottom tube 1 and two rear bottom tubes 14 respectively extending from the two opposite ends of the central bottom tube 1, two spaced-apart middle upright tubes 11, 12 respectively extending upwardly from the two opposite ends of the central bottom tube 1, a central top tube 13 joined between the two middle upright tubes 11, 12, two front top tubes 151, 152 respectively extending from two opposite ends of the central top tube 13 and parallel to the front bottom tubes 161, 162, and left and right upright tubes 17, 18 respectively extending upwardly from the two front bottom tubes 161, 162 to respectively join with the front top tubes 151, 152. The left upright tube 17 defines a plurality of adjustment holes 170 along an entire length thereof. The right upright tube 18 defines a plurality of adjustment holes 180 along an entire length thereof. A first sleeve 191 is attached to the middle upright tube 11. A second sleeve 192 is attached to the middle upright tube 12. The first machanism generally includes a first weight stack 21, a first cable system 3, and a second cable system 5. The second machanism generally includes a second weight stack 22, a third cable system 4, and a fourth cable system 6.

As shown in FIG. 2, the first and second weight stacks 21, 22 are placed over the central bottom tube 1. The first weight stack 21 is stacked up with a plurality of weight plates 212 and can be attached to the second cable system 5 through a connector 211. The second weight stack 22 is stacked up with a plurality of weight plates 222 and can be attached to the fourth cable system 6 through a connector 221.

Referring again to FIGS. 1 through 3, the first cable system 3 includes a first adjustment assembly 31, a first adjustable pulley block 32, a first cable 33, a first group of fixed pulleys 34, 35, 36, 38, 39 mounted at the supportive frame, a first moving pulley block 37, and a first handle 331, wherein the first adjustable pulley block 32 is attached to the first adjustment assembly 31 and includes an upper sheave 321 and a lower sheave 322 (see FIG. 1). More specifically, the fixed pulleys 34, 35 are mounted at the front top tube 151; the fixed pulley 36 is mounted at the rear bottom tube 14 (left); the fixed pulleys 38, 39 are mounted at the front bottom tube 161. The first adjustment assembly 31 includes a shell fitted around the left upright tube 17, and a positioning pin 310 (see FIG. 1), wherein the shell defines a positioning hole (not labeled) and provided with a holder 311 to facilitate moving the shell along the tube 17. The positioning pin 310 can be inserted through the positioning hole of the shell and one of the adjustment holes 170 of the left upright tube 17, so that the first adjustment assembly 31 together with the first adjustable pulley block 32 can be selectively and detachably fixed at a predetermined height. The first cable 33 is connected at a first end thereof to the first adjustment assembly 31 and sequentially routed around the fixed pulleys 39, 38, the first moving pulley block 37, the fixed pulleys 36, 35, 34, and the upper sheave 321 and the lower sheave 322 of the first adjustable pulley block 32, and finally connected at a second end thereof to the first handle 331. The second cable system 5 includes a second cable 50, a second group of fixed pulleys 51, 52, 54 mounted at the supportive frame, and a second moving pulley block 53 connected with the first weight stack 21. More specifically, the fixed pulleys 51, 52, 54 are mounted at the central top tube 13. The second cable 50 is connected at a first end thereof to a casing of the first moving pulley block 37, and sequentially routed around the fixed pulley 54, the second moving pulley block 53, the fixed pulleys 52, 51, and finally inserted through the first sleeve 191 to be anchored at a second end thereof, wherein an anchor plate 57 defining a mounting hole (not shown) is attached to the second end of the second cable 50 having been inserted through the first sleeve 191, so that the second end of the second cable 50 can be stopped or fixed by the first sleeve 191.

Referring again to FIGS. 1 through 3, the third cable system 4, which is similar to the first cable system 3, includes a second adjustment assembly 41, a second adjustable pulley block 42, a third cable 43, a third group of fixed pulleys 44, 45, 46, 48, 49 mounted at the supportive frame, a third moving pulley block 47, and a second handle 431, wherein the second adjustable pulley block 42 is attached to the second adjustment assembly 41 and includes an upper sheave 421 and a lower sheave 422 (see FIG. 1). More specifically, the fixed pulleys 44, 45 are mounted at the front top tube 152; the fixed pulley 46 is mounted at the rear bottom tube 14 (right); the fixed pulleys 48, 49 are mounted at the front bottom tube 162. The second adjustment assembly 41, which is same as the first adjustment assembly 31, includes a shell fitted around the right upright tube 18, and a positioning pin 410 (see FIG. 1), wherein the shell defines a positioning hole (not labeled) and provided with a holder 411 to facilitate moving the shell along the tube 18. The positioning pin 410 can be inserted through the positioning hole of the shell and one of the adjustment holes 180 of the right upright tube 18, so that the second adjustment assembly 41 together with the second adjustable pulley block 42 can be selectively and detachably fixed at a predetermined height. The third cable 43 is connected at a first end thereof to the second adjustment assembly 41 and sequentially routed around the fixed pulleys 49, 48, the third moving pulley block 47, the fixed pulley 46, 45, 44, the upper sheave 421 and the lower sheave 422 of the second adjustable pulley block 42, and finally connected at a second end thereof to the second handle 431. The fourth cable system 6, which is similar to the third cable system 5, includes a second cable 60, a fourth group of fixed pulleys 61, 62, 64 mounted at the supportive frame, and a fourth moving pulley block 63 connected with the second weight stack 22. More specifically, the fixed pulleys 61, 62, 64 are mounted at the central top tube 13. The fourth cable 60 is connected at a first end thereof to a casing of the third moving pulley block 47, and sequentially routed around the fixed pulley 64, the fourth moving pulley block 63, the fixed pulleys 62, 61, and finally inserted through the second sleeve 192 to be anchored at a second end thereof, wherein an anchor plate 67 defining a mounting hole 670 (see FIG. 5) is attached to the second end of the fourth cable 60 having been inserted through the second sleeve 192 and thus the second end of the fourth cable 60 can be stopped or fixed by the second sleeve 192.

It is noted that the arrangement or number of the fixed pulleys used in the weight training machine is not limited to that shown in the above embodiment. Any combination or number of fixed pulleys can be used to achieve the purpose of transferring the force from a handle to a weight stack. In another embodiment, as shown in FIG. 4, the second cable system 5 employs two fixed pulleys 55, 56 in stead of the pulley 54 used in the previous embodiment; the fourth cable system 6 employs two fixed pulleys 65, 66 instead of the fixed pulley 64 used in the previous embodiment.

Figure 4:
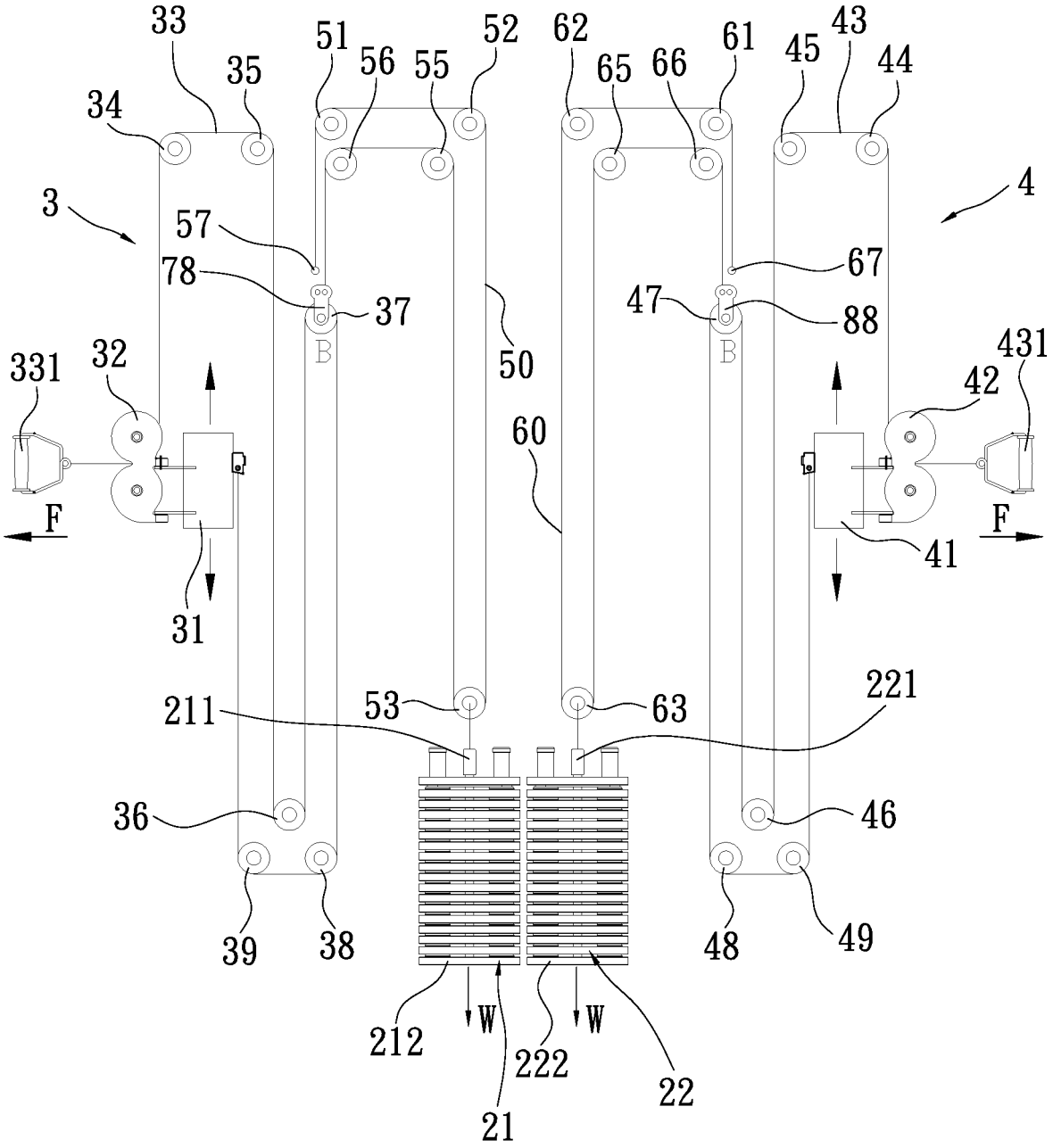
FIG. 4 shows a schematic view of a weight training machine according to another embodiment of the present invention.

Referring to FIGS. 2 through 4, in use, the position of the adjustment assemblies 31, 41 can be first adjusted at a height according to the height or requirement of a user. Next, the first and second handles 331, 431 can be grasped by two hands of the user. As each handle is pulled down by the user, a force (F) applied to the first handle 331 can be transferred by the first cable system 3 and the second cable system 5 of the first mechanism to the first weight stack 21 with a weight (W), thus lifting the third weight stack 21; the force (F) applied to the second handle 431 can be transferred by the third cable system 4 and the fourth cable system 6 of the second mechanism to the second weight stack 22 with a weight (W), thus lifting the second weight stack 22. As the user slightly reduces the force applied to each handle, the first and second weight stacks 21, 22 can returns to their original positions. With repeated lifting and lowering of the weight stacks, 21, 22, the user may exercise the chest and back muscle. In this operational mode, since there are two moving pulley blocks employed in each of the first and second mechanism, the force applied to each handle is equal to one fourth of the weight of either weight stack, i.e., F=¼ W.

Figure 5:
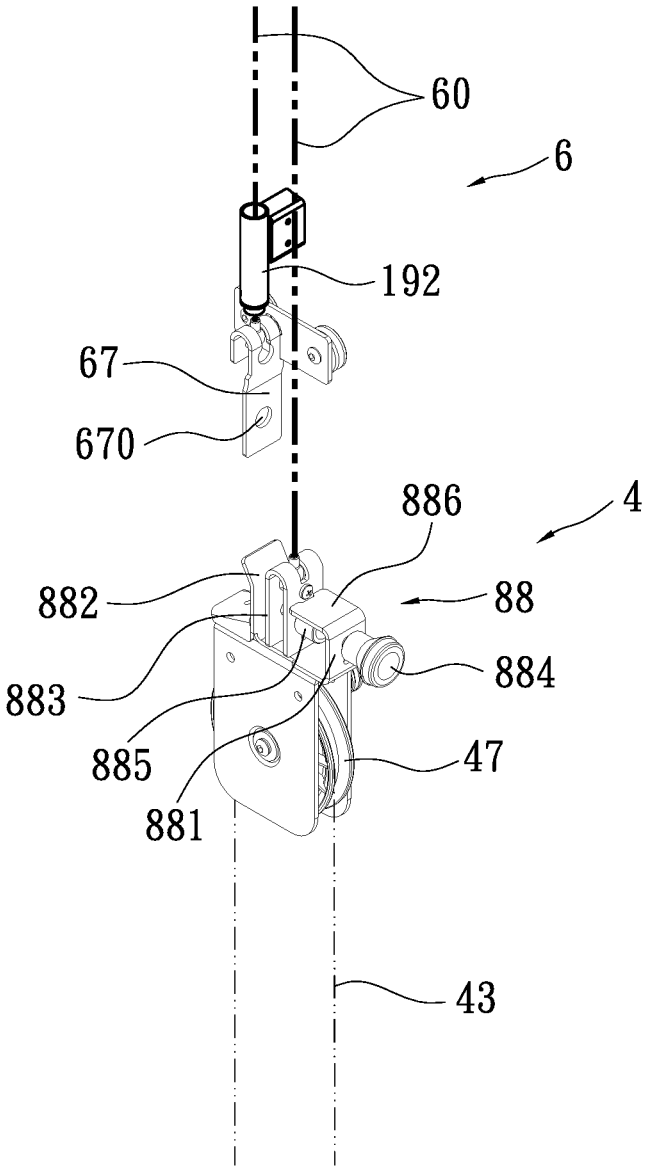
FIG. 5 shows a 3-dimensional view of an attachment means used for attaching a second end of a cable to a moving pulley block, wherein the second end of the cable has not been attached to the moving pulley block
Figure 6:
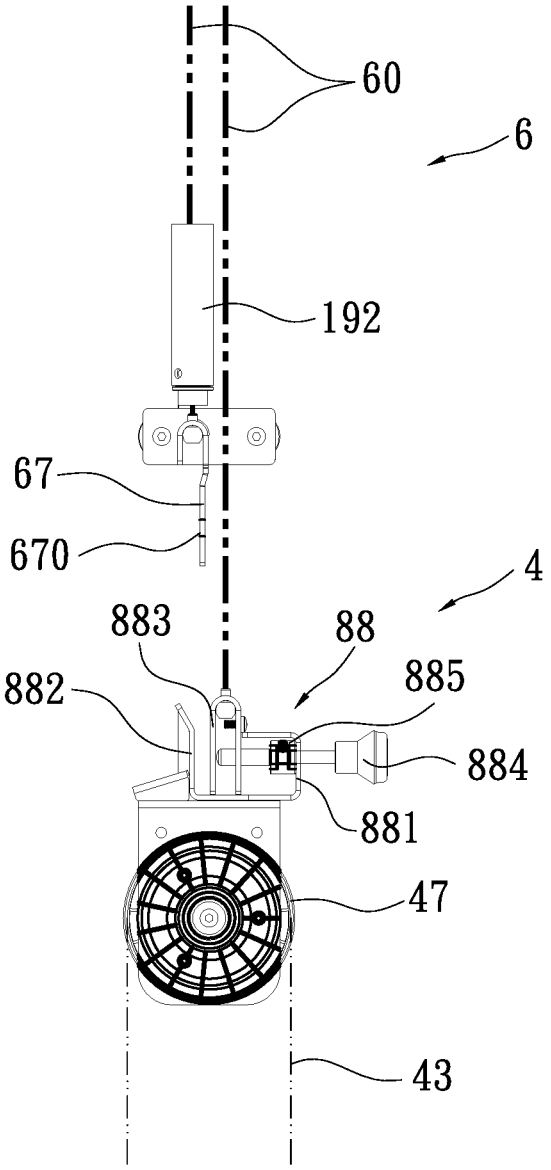
FIG. 6 shows a front view of the attachment means shown in FIG. 5.
Figure 7:
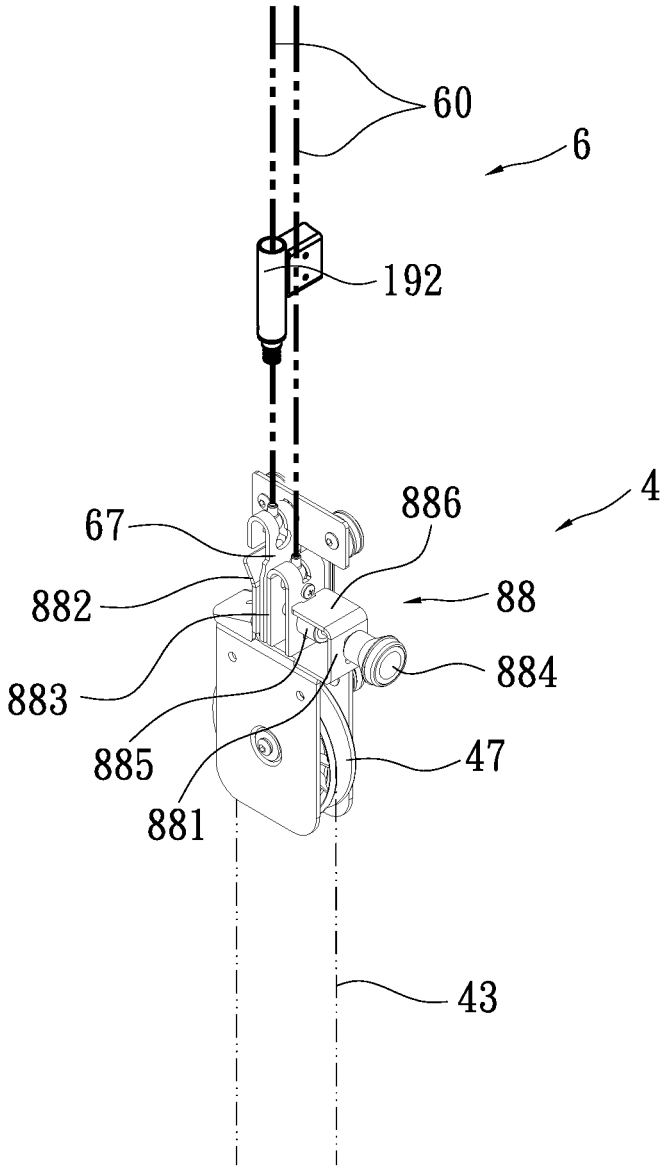
FIG. 7 shows a 3-dimensional view of the attachment means, wherein the second end of the cable has been attached to the moving pulley block.
Figure 8:
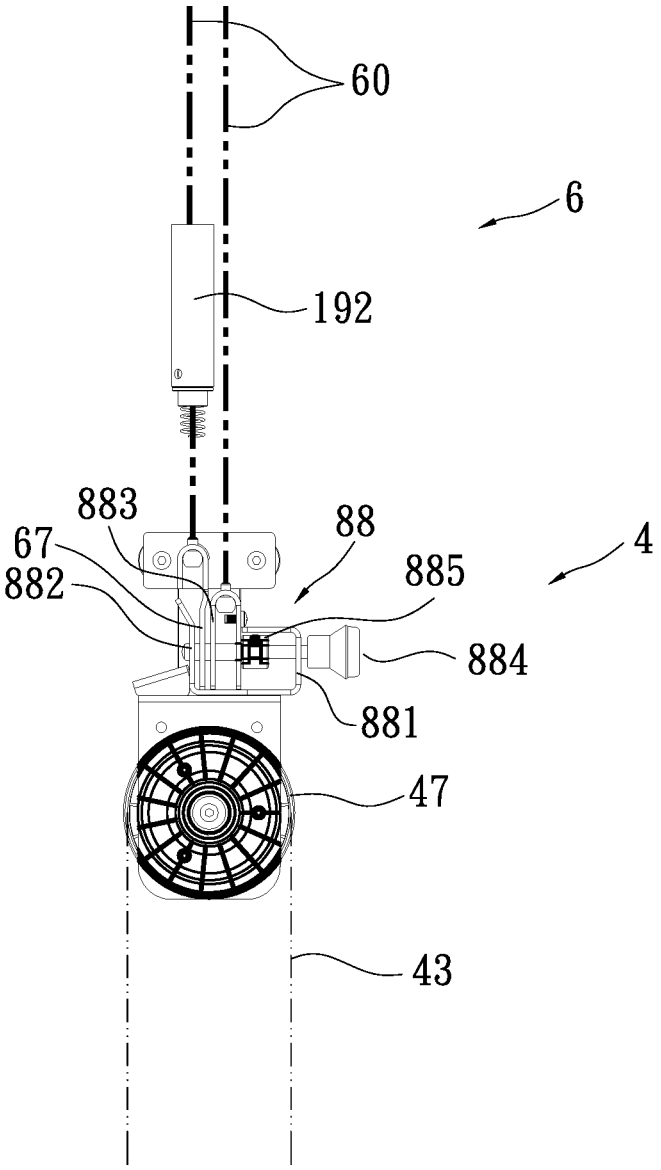
FIG. 8 shows a front view of the attachment means shown in FIG. 7.

Referring to FIGS. 3, 5 and 6, the third moving pulley block 47 is provided with an attachment means 88, which generally includes a bracket formed of a metal strip, and a fastening pin 884. The bracket has a first lateral side 881 defining a hole (not labeled), a second lateral side 882 defining a hole (not labeled), a bottom side (not labeled) between the first and second lateral sides 881, 882 and attached to the casing of the third moving pulley block 47, and a top side 886 extending from the first lateral side 881 and parallel to the bottom side and spaced from the second lateral side 882, wherein the fastening pin 884 is provided with a magnet 885 adjacent to the top side 886. The first end of the fourth cable 60 is attached with a U-shaped member 883, which is located between the second lateral side 882 and the top side 886 of the bracket and defines two holes aligned with the holes of the first and second lateral sides 881, 882 of the bracket, such that the fastening pin 884, when at a first position (see FIGS. 5 and 6), can be inserted through the hole of the first lateral side 881 and one or two of the holes of the U-shaped member 883. The anchor plate 67, which is attached at the second end of the fourth cable 60, can be inserted between the U-shaped member 883 and the second lateral side 882 of the bracket to have the mounting hole 670 of the anchor plate 67 aligned with the holes of the bracket and the U-shaped member 883, such that the fastening pin 884, when at a second position (see FIGS. 7 and 8), can be inserted through the holes of the bracket and the U-shaped member 883 and the mounting hole 670 of the anchor plate 67, and the magnet 885 can be located adjacent to the top side 886 of the bracket as well as the U-shaped member 883, so that the fastening pin 884 can stay in place, and thus the second end of the fourth cable 60 can be detachably attached to the casing of the third moving pulley block 47. As such, the third moving pulley block 47 can be stopped by the second sleeve 192, so that the third moving pulley block 47 can be converted to a fixed pully. Therefore, there exists only one moving pulley block (i.e. the fourth moving pulley block 63) in the second mechanism which includes the third and fourth cable systems 4, 6. In this operational mode, the force (F) applied to the second handle 431 for lifting the second weight stack 22 becomes double, i.e. F=½ W. Similarly, the first moving pulley block 37 is provided with an attachment means 78, which is same as the one used with the third moving pulley block 47. Thus, a description for the components, including the attachment means 78 and the anchor plate 57 attached at the second end of the second cable 50, is omitted here. In use, after the second of the second cable 50 is attached to the first moving pulley block 37, the force required for lifting the first weight stack 21 becomes double; after the second end of the fourth cable 60 is attached to the third moving pulley block 47, the force required for lifting the second weight stack 22 becomes double.

As a summary, the present invention includes two separate mechanisms, each of which includes two cable systems and involves a weight stack 21 or 22, wherein one end of a cable can be detachably attached to one moving pulley block 37 or 47, so that the moving pulley block can be converted to a fixed pulley, and thus the force required for lifting the corresponding weight stack becomes double. On the other hand, when the end of the cable is detached from the associated moving pulley block, the force required for lifting the corresponding weight stack returns to its original load.

While the invention has been described with reference to the preferred embodiments above, it should be recognized that the preferred embodiments are given for the purpose of illustration only and are not intended to limit the scope of the present invention and that various modifications and changes, which will be apparent to those skilled in the relevant art, may be made without departing from the scope of the invention.

What is claimed is:

1. A weight training machine, comprising:

a supportive frame; and a first mechanism including:

a first weight stack being stacked up with a plurality of weight plates;

a first cable system including a first adjustment assembly, a first adjustable pulley block attached to the first adjustment assembly, a first cable, a first group of fixed pulleys mounted at the supportive frame, a first moving pulley block, and a first handle for being grasped by one hand of a user, wherein the first cable is connected at a first end thereof to the first adjustment assembly and routed around the first group of fixed pulleys and the first moving pulley block and the first adjustable pulley block, and connected at a second end thereof to the first handle; and a second cable system including a second cable, a second group of fixed pulleys mounted at the supportive frame, and a second moving pulley block connected with the first weight stack, the second cable being connected at a first end thereof to a casing of the first moving pulley block and routed around the second group of fixed pulleys and the second moving pulley block, and inserted through a first sleeve fixed at the supportive frame to be anchored at a second end thereof, wherein the second end of the second cable allows to be detachably attached to the casing of the first moving pulley block to have the first moving pulley block stopped by the first sleeve, so that the force applied to the first handle to lift the first weight stack becomes double.

2. The weight training machine of claim 1, further comprising:

a second mechanism including:

a second weight stack being stacked up with a plurality of weight plates;

a third cable system including a second adjustment assembly, a second adjustable pulley block attached to the second adjustment assembly, a third cable, a third group of fixed pulleys mounted at the supportive frame, a third moving pulley block, and a second handle for being grasped by the other hand of the user, the third cable being connected at a first end thereof to the second adjustment assembly and routed around the third group of fixed pulleys and the third moving pulley block and the second adjustable pulley block, and connected at a second end thereof to the second handle; and a fourth cable system including a fourth cable, a fourth group of fixed pulleys, and a fourth moving pulley block connected with the second weight stack, the fourth cable being connected at a first end thereof to a casing of the third moving pulley block and routed around the fourth group of fixed pulleys and the fourth moving pulley block, and anchored at a second end thereof to a second sleeve fixed at the supportive frame, wherein the second end of the fourth cable allows to be detachably attached to the casing of the third moving pulley block to have the third moving pulley block stopped by the second sleeve, so that the force applied to the second handle to lift the second weight stack becomes double.

3. The weight training machine of claim 2, wherein the supportive frame is constructed of a base formed of a central bottom tube and two front bottom tubes respectively extending from two opposite ends of the central bottom tube and two rear bottom tubes respectively extending from the two opposite ends of the central bottom tube, two middle upright tubes respectively extending upwardly from the two opposite ends of the central bottom tube, a central top tube joined between the two middle upright tubes, two front top tubes respectively extending from two opposite ends of the central top tube and parallel to the front bottom tubes, and left and right upright tubes respectively extending upwardly from the two front bottom tubes to respectively join with the two front top tubes; wherein each of the left and right upright tubes defines a plurality of adjustment holes along an entire length thereof; the first and second sleeves are respectively attached to the two middle upright tubes.

4. The weight training machine of claim 3, wherein the first adjustment assembly includes a shell fitted around the left upright tube, and a positioning pin, the shell defining a positioning hole and provided with a holder, the positioning pin capable of being inserted through the positioning hole of the shell and one of the adjustment holes of the left upright tube; the first adjustable pivot block includes an upper sheave and a lower sheave and is attached to the shell of the first adjustment assembly, so that first adjustable pivot block together with the first adjustment assembly can be selectively fixed at a predetermined height; the first cable is routed around the upper and lower sheaves of the first adjustable pivot block and fixed at its second end to the first handle; the second adjustment assembly includes a shell fitted around the right upright tube, and a positioning pin, the shell defining a positioning hole and provided with a holder, the positioning pin capable of being inserted through the positioning hole of the shell and one of the adjustment holes of the right upright tube; the second adjustable pivot block includes an upper sheave and a lower sheave and is attached to the shell of the second adjustment assembly, so that the second adjustable pivot block together with the second adjustment assembly can be selectively fixed at a predetermined height; the second cable is routed around the upper and lower sheaves of the second adjustable pivot block and fixed at its second end to the second handle.

5. The weight training machine of claim 4, wherein the first moving pulley block is provided with an attachment means, which includes a bracket formed of a metal strip, and a fastening pin, the bracket having a first lateral side defining a hole, a second lateral side defining a hole, a bottom side between the first and second lateral sides and attached to the casing of the first moving pulley block, and a top side extending from the first lateral side and parallel to the bottom side and being spaced from the second lateral side, the fastening pin being provided with a magnet adjacent to the top side of the bracket, the first end of the second cable being attached with a U-shaped member located between the second lateral side and the top side of the bracket and defining two holes aligned with the holes of the bracket, such that the fastening pin, when at a first position, is inserted through the hole of the first lateral side of the bracket and one or two of the holes of the U-shaped member, the second end of the second cable being attached with an anchor plate defining a mounting hole, the anchor plate being stopped by the first sleeve and capable of being inserted between the U-shaped member and the second lateral side of the bracket to have the mounting hole of the anchor plate aligned with the holes of the bracket and the U-shaped member such that the fastening pin, when at a second position, is inserted through the holes of the bracket and the U-shaped member and the mounting hole of the anchor plate, and the magnet is located adjacent to the top side of the bracket as well as the U-shaped member, so that the second end of the second cable is detachably attached to the casing of the first moving pulley block; the third moving pulley block is provided with an attachment means, which includes a bracket formed of a metal strip, and a fastening pin, the bracket having a first lateral side defining a hole, a second lateral side defining a hole, a bottom side between the first and second lateral sides and attached to the casing of the third moving pulley block, and a top side extending from the first lateral side and parallel to the bottom side and being spaced from the second lateral side, the fastening pin being provided with a magnet adjacent to the top side of the bracket, the first end of the fourth cable being attached with a U-shaped member located between the second lateral side and the top side of the bracket and defining two holes aligned with the holes of the bracket, such that the fastening pin, when at a first position, is inserted through the hole of the first lateral side of the bracket and one or two of the holes of the U-shaped member, the second end of the fourth cable being attached with an anchor plate defining a mounting hole, the anchor plate being stopped by the second sleeve and capable of being inserted between the U-shaped member and the second lateral side of the bracket to have the mounting hole of the anchor plate aligned with the holes of the bracket and the U-shaped member such that the fastening pin, when at a second position, is inserted through the holes of the bracket and the U-shaped member and the mounting hole of the anchor plate, and the magnet is located adjacent to the top side of the bracket as well as the U-shaped member, so that the second end of the fourth cable is detachably attached to the casing of the third moving pulley block.

* * * * *